US011238687B2

(12) United States Patent
Dano

(10) Patent No.: US 11,238,687 B2
(45) Date of Patent: Feb. 1, 2022

(54) COMPACT AUTOMATIC COIN COUNTER

(71) Applicant: CTCOIN A/S, Odense (SV)

(72) Inventor: Bjarne Dano, Odense (SV)

(73) Assignee: CTCOIN A/S, Odense (DK)

( * ) Notice: Subject to any disclaimer, the term of this patent is extended or adjusted under 35 U.S.C. 154(b) by 0 days.

(21) Appl. No.: 16/342,527

(22) PCT Filed: Oct. 13, 2017

(86) PCT No.: PCT/DK2017/050341
§ 371 (c)(1),
(2) Date: Apr. 16, 2019

(87) PCT Pub. No.: WO2018/072802
PCT Pub. Date: Apr. 26, 2018

(65) Prior Publication Data

US 2019/0266829 A1 Aug. 29, 2019

(30) Foreign Application Priority Data

Oct. 17, 2016 (DK) ..... PA 2016 00635

(51) Int. Cl.
*G07D 9/00* (2006.01)

(52) U.S. Cl.
CPC ..... *G07D 9/008* (2013.01)

(58) Field of Classification Search
CPC ..... G07D 9/008; G07D 3/00; G07D 3/06; G07D 3/126; G07D 3/128
USPC ..... 453/6, 10, 12, 13, 33–35, 49, 57
See application file for complete search history.

(56) References Cited

U.S. PATENT DOCUMENTS

| | | | | |
|---|---|---|---|---|
| 3,422,824 | A * | 1/1969 | Persson | G07D 9/008 453/8 |
| 2002/0170801 | A1* | 11/2002 | Martin | G07D 3/16 194/200 |
| 2015/0140912 | A1* | 5/2015 | Chien | G07D 9/008 453/57 |
| 2020/0388097 | A1* | 12/2020 | Nishida | G07D 3/06 |

* cited by examiner

*Primary Examiner* — Jeffrey A Shapiro
(74) *Attorney, Agent, or Firm* — FisherBroyles, LLP

(57) ABSTRACT

A compact automatic coin counter (1) is disclosed, comprising a coin bowl (3), a coin wheel (4), a coin track (8), a coin rail (14) and a coin sensor (9), wherein the coin wheel is inclined with its lowermost part within the coin bowl and is provided with one or more recesses (5) for collection of coins from the coin bowl, and wherein the coin wheel is further provided with a circular coin path (15) passing across the recesses and consisting of one or more grooves (6) deeper recessed in the axial direction than these recesses, and the coin rail is provided with one or more coin lifters (7), which extend into these grooves in such a way that the coin lifters lift the coins from the recesses in the coin wheel onto the coin track, where they individually roll past the coin sensor, which type each coin, after which the total value of the counted coins is calculated.

12 Claims, 3 Drawing Sheets

COMPACT AUTOMATIC COIN COUNTER

Figure 1:
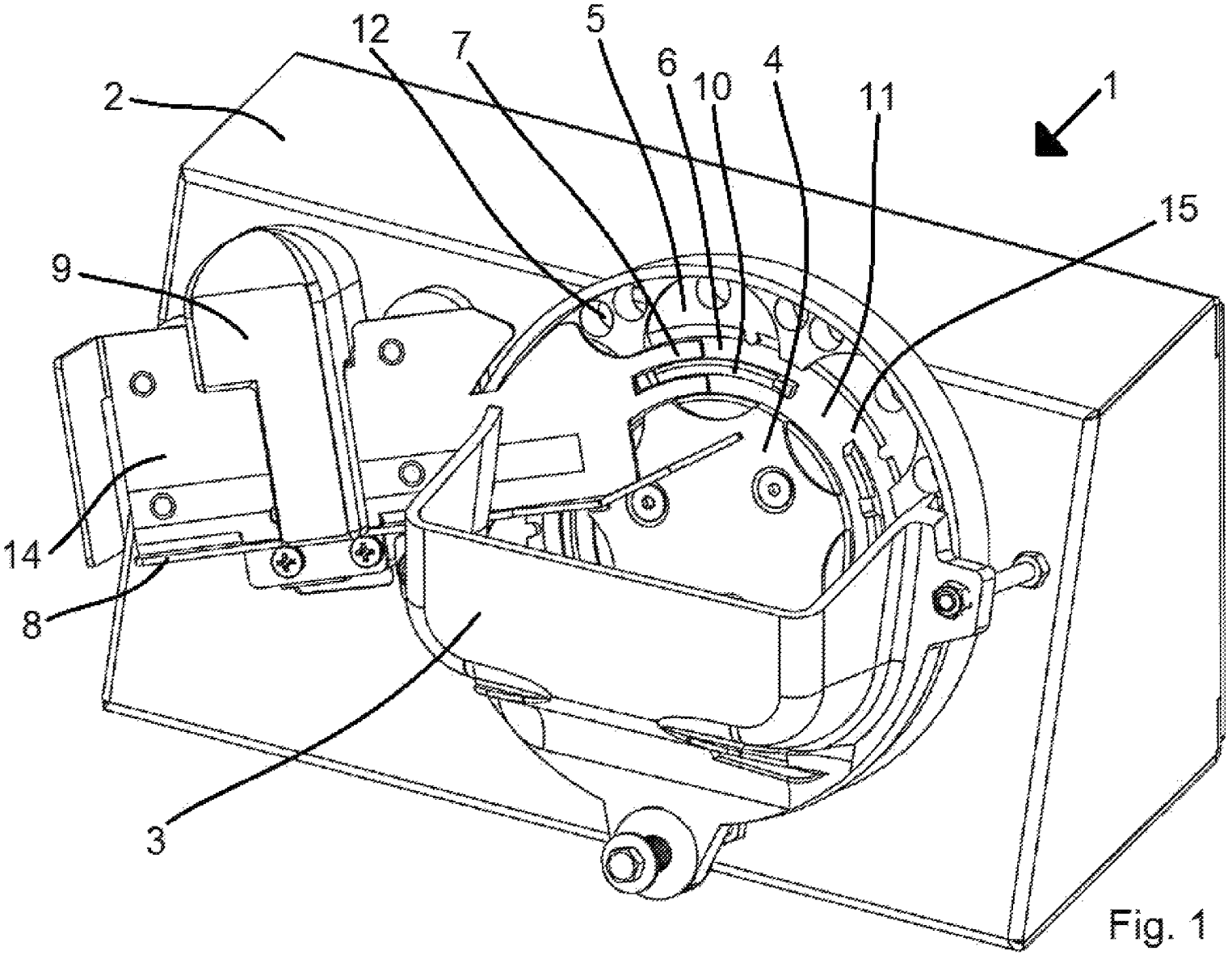

The present invention relates to an automatic coin counter and, in particular, to a compact coin counter, which is physically smaller than conventional coin counters.

BACKGROUND OF THE INVENTION

Most known automatic coin counters are relatively large and space-consuming machines.

The most known technique for collecting the coins from a coin bowl, into which the coins desired to be counted are poured, uses a rotating disk (a so-called coin wheel) with a number of wedge-shaped carriers pushing the coins onto a coin track. The coins then roll one after the other along this coin track past a coin sensor, which types and counts the coins, after which they are sorted by type.

The diameter of the coin wheel is determined by the required centrifugal force impact of the largest/heaviest coin desired to be sorted in combination with the fact that the coin wheel can rotate only at a certain speed without causing problems for the coin pickup by the carriers. This means that, in conventional coin counters, the coin wheel—and thus also the coin counters as such—will be relatively large.

U.S. Pat. No. 5,988,348 A1 discloses an automatic coin counter, which comprises a coin bowl, a coin wheel with a circular coin path, a coin track, a coin rail and a coin sensor. The coin wheel is arranged to be able to rotate and is inclined with its lowermost part within the coin bowl.

BRIEF DESCRIPTION OF THE INVENTION

It is an object of the present invention to provide a coin counter, which overcomes the above-mentioned problems related to the known technique within the field of art.

The present invention relates to a compact automatic coin counter comprising a coin bowl, a coin wheel, a coin track, a coin rail and a coin sensor, wherein the coin wheel, which is arranged to be able to rotate, is inclined with its lowermost part within the coin bowl and is provided with one or more recesses for collection of coins from the coin bowl so that coins, which are caught in these recesses when the recesses pass through the coin bowl at rotation of the coin wheel, follow the movement of the recesses upwardly on the rotating coin wheel, and wherein the coin wheel is further provided with a circular coin path passing across the recesses for collection of coins and consisting of one or more grooves deeper recessed in the axial direction than these recesses, and the coin rail is provided with one or more coin lifters, which extend into these grooves in such a way that the coin lifters lift the coins from the recesses in the coin wheel onto the coin track, where they lean against the coin rail and individually roll past the coin sensor, which type each coin, after which the total value of the counted coins is calculated.

Such a configuration of the coin counter makes it possible to reduce the dimensions of the coin wheel considerably because the coins in a coin counter according to the invention are not lifted by the use of carriers and centrifugal force, but instead by recesses for reception of coins in the actual coin wheel, from which the coin lifters lead the coins forward to the coin track.

In an embodiment of the invention, the recesses for collection of coins are circular in configuration.

In an embodiment of the invention, the diameter of the recesses for collection of coins is between 2 cm and 7 cm, preferably between 3 cm and 5 cm.

Such sizes of the recesses mean that they will typically be large enough to receive the physically largest coins without being so large that they can receive more of the physically smallest coins next to each other at the same time.

In an embodiment of the invention, the depth of the recesses for collection of coins is adapted so that each recess can only transport a single coin up from the coin bowl at a time.

If the depth of the recesses makes them unable to accommodate more coins on top of each other, it is typically not necessary with other systems to ensure that only one coin is transported in a recess at a time.

In an embodiment of the invention, the recesses for collection of coins are arranged along the outer periphery of the coin wheel.

In an embodiment of the invention, the coin path is divided into two grooves separated by an elevation in the middle of the coin path along at least the main part of its circular course on the coin wheel and there are two coin lifters from the coin rail extending into respective grooves on respective sides of this elevation.

The use of such a coin path having two grooves with an elevation between them and two coin lifters from the coin rail provides a more stable and "tilt-proof" transport of coins than the use of a coin track with only one groove and only one coin lifter from the coin rail.

In an embodiment of the invention, the elevation is missing at one or more locations along the course of the coin path.

Such gaps in the elevation form so-called "coin drops", which can seize the edge of coins lying more or less perpendicular to the coin wheel and tip these coins in a direction more parallel to the coin wheel so that the coins can be received by the recesses therein.

In an embodiment of the invention, the elevation is provided with rounded edges.

Together with a milled groove within the coin wheel, an appropriate rounding of the edges of the elevation reduces the risk of coins getting stuck in the system.

In an embodiment of the invention, the coin wheel is further provided with one or more through-going holes, which are so small that the coins cannot pass through them.

Such holes make is possible for dirt and various impurities to leave the coin wheel therethrough.

In an embodiment of the invention, the weight of the coin counter is less than 10 kg, preferably less than 5 kg, most preferably less than 3 kg.

In an embodiment of the invention, the length of the coin counter is less than 40 cm, preferably less than 25 cm.

In an embodiment of the invention, the height and width of the coin counter are both less than 30 cm, preferably less than 20 cm.

DRAWINGS

Figure 2:
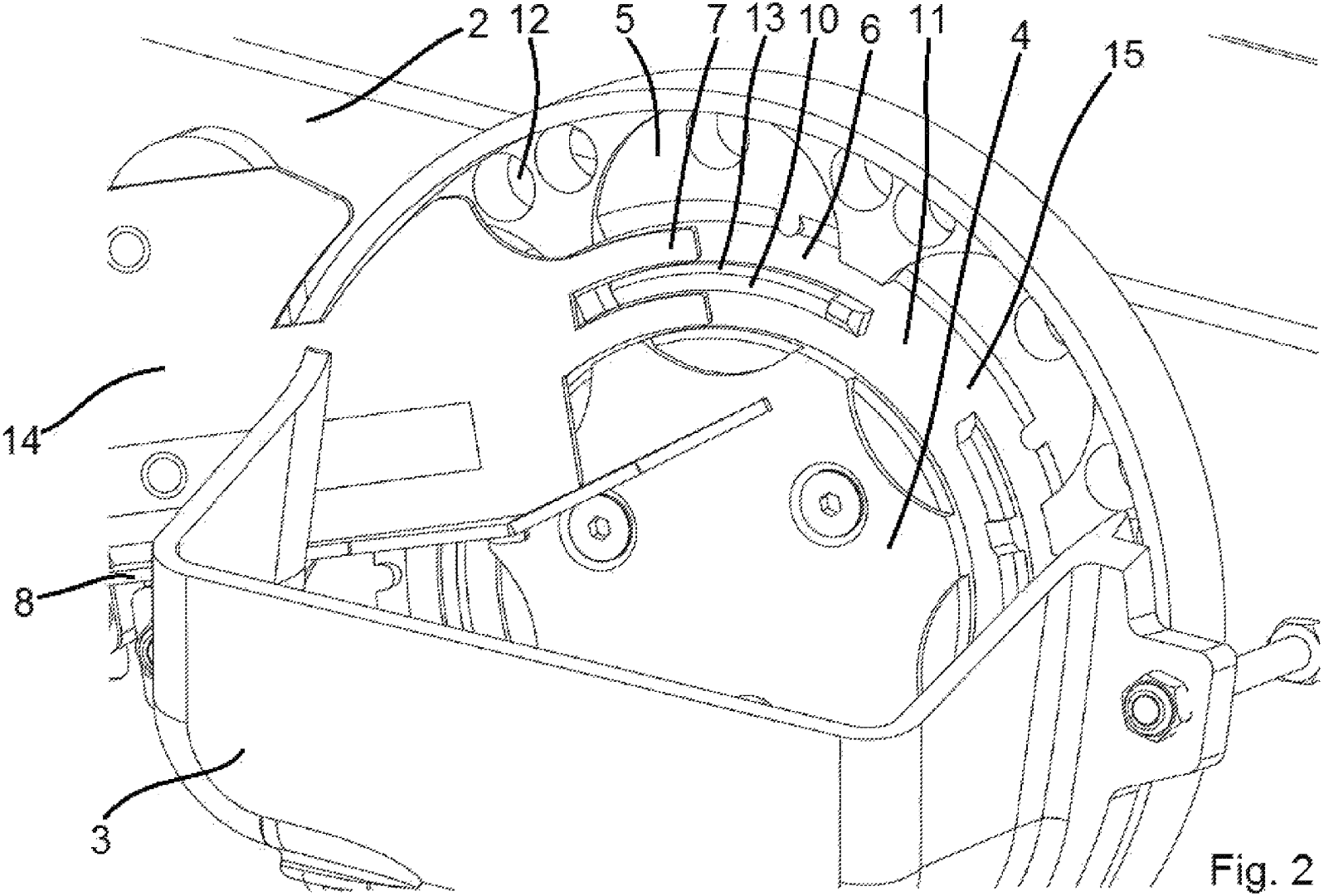
Figure 3:
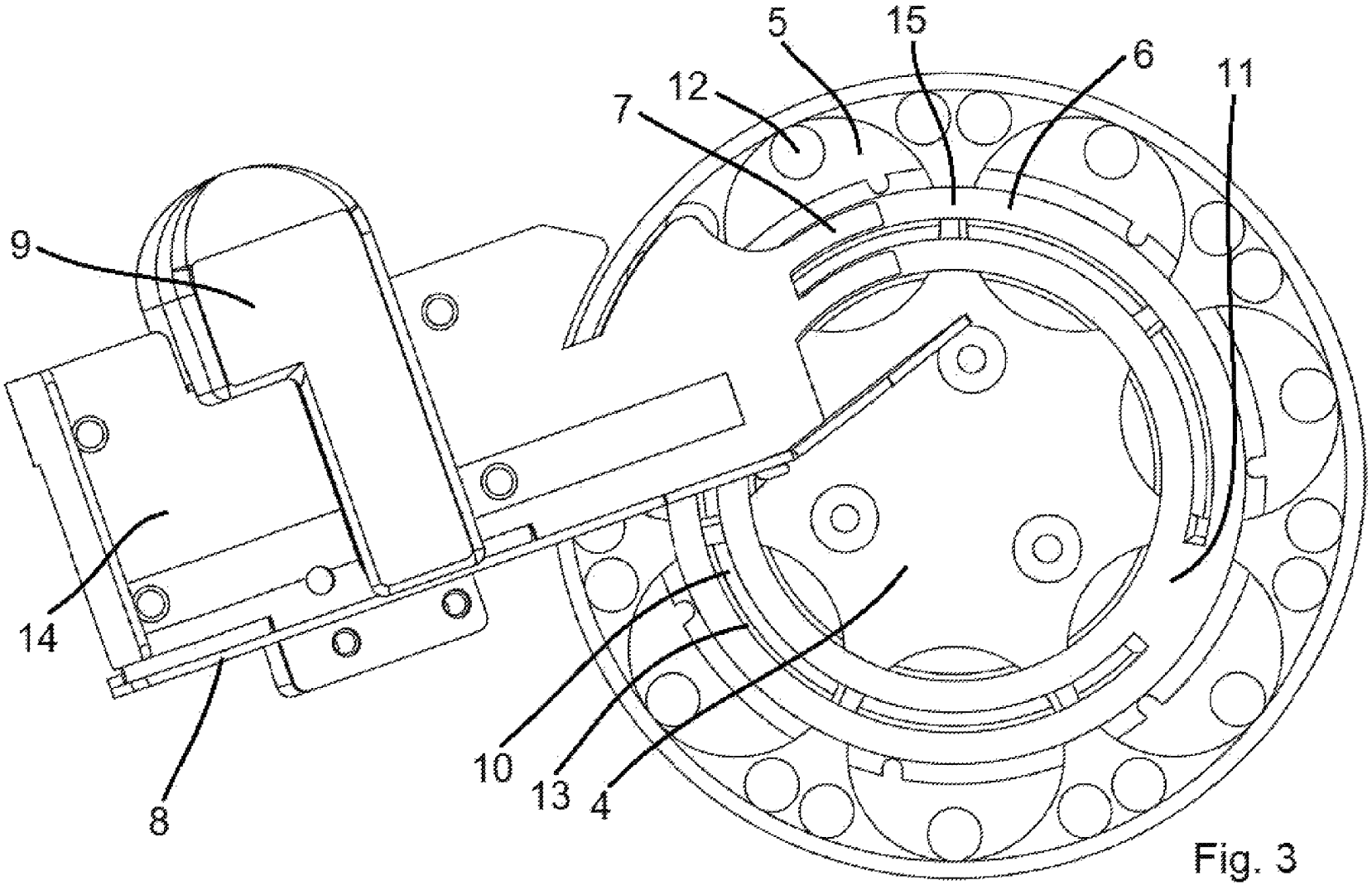

In the following, a few exemplary embodiments of the invention are described in more detail with reference to the drawings, of which FIG. 1 is a schematic drawing of an automatic coin counter according to the invention, FIG. 2 is an enlarged segment of FIG. 1, and FIG. 3 is a schematic drawing of some of the most important technical parts of the coin counter shown in FIG. 1.

DETAILED DESCRIPTION OF THE INVENTION

FIG. 1 and FIG. 2, which is an enlarged section of FIG. 1, are schematic drawings of a compact automatic coin counter 1 according to the invention, whereas FIG. 3 is a drawing of the coin wheel 4, the coin track 8, the coin rail 14 and the coin sensor 9 of this coin counter 1.

In the illustrated embodiment, the coin wheel 4, the coin track 8, the coin rail 14 and the coin sensor 9 are mounted on the inclined front side of a base/console 2, which contains a motor for rotation of the coin wheel 4, power supply for the coin sensor 9 and the necessary electronics for registration and calculation of the value of the coins passing the coin sensor 9.

The base/console 2 has physical dimensions making it suitable for installation in other applications, in which coin counting is desired.

A coin bowl 3 is mounted on the front of the base/console 2, and the coin wheel 4, which is arranged parallel to the front of the base/console 2 and, thus, inclined, extends with its lowermost part down into this coin bowl 3. A series of circular recesses 5 in the coin wheel 4 is arranged along its outer periphery for collection of coins from the coin bowl 3 when the recesses pass therethrough. The size and depth of these recesses 5 are adapted so that each recess 5 can only transport a single coin at a time.

The coin wheel 4 is further provided with a coin path 15 in the form of a circular recess passing across the aforesaid recesses 5 and being deeper recessed in the axial direction than these. In the illustrated embodiment of the invention, the coin path 15 is divided into two grooves 6 separated by an elevation 10 whose edges are rounded 13 to reduce the risk of coins getting stuck within the coin bowl 3. Two coin lifters 7 from the coin rail 14 extend into respective grooves 6 on respective sides of this elevation 10 so that they seize the coins within the recesses 5 and lift them onto the coin track 8.

In other embodiments of the invention, the coin path 15 may consist of a single groove 6 and there may be one or more coin lifters 7 from the coin rail 14 extending into this groove 6, but the illustrated solution with two grooves 6, each with its respective coin lifter 7, has proven to be more stable and reduces the risk of the coins "tilting" and falling back into the coin bowl 3 in connection with the transfer from the coin wheel 4 to the coin track 8.

In addition, the use of an elevation 10 along the centre of the coin path 15 makes it possible to make so-called "coin drops" 11 in the form of "gaps" in the elevation 10, which can seize the edge of coins lying more or less perpendicular to the coin wheel 4 and tip these coins in a direction more parallel to the coin wheel 4 so that the coins can be received by the recesses 5 therein.

Once the coins are lifted onto the coin track 8, they roll individually along it while they "lean" against the coin rail 14 and pass the coin sensor 9, which types each coin and signals the electronics inside the base/console 2 keeping track of the value of the counted coins.

The figures further show how the coin wheel 4 may be provided with a number of through-going holes 12 for the passage of dirt and other matters.

The illustrated embodiment of the invention does not comprise systems for sorting and collecting the coins as they leave the coin track 8, but other embodiments may contain such systems, in which the sorting takes place on the basis of data from the coin sensor 9.

LIST OF REFERENCE NUMBERS

1. Coin counter
2. Base/console
3. Coin bowl
4. Coin wheel
5. Recess for collection of coins
6. Groove in coin path
7. Coin lifter
8. Coin track
9. Coin sensor
10. Elevation centrally in coin path
11. Coin drop
12. Through-going hole for passage of dirt and other matters
13. Rounded edge of elevation
14. Coin rail
15. Coin path

The invention claimed is:

1. A compact automatic coin counter (1) comprising:
a coin bowl (3),
a coin wheel (4),
a coin track (8),
a coin rail (14),
and a coin sensor (9),
wherein the coin wheel (4) is arranged to rotate, and is inclined with its lowermost part within the coin bowl (3),
wherein the coin wheel (4) is provided with one or more recesses (5) for collection of coins from the coin bowl (3) so that coins, which are caught in these recesses (5) when the recesses (5) pass through the coin bowl (3) at rotation of the coin wheel (4), follow the movement of the recesses (5) upwardly on the rotating coin wheel (4),
wherein the coin wheel (4) is further provided with a circular coin path (15) passing across the recesses (5) for collection of coins and consisting of one or more grooves (6) deeper recessed in the axial direction than these recesses (5), and the coin rail (14) is provided with one or more coin lifters (7), which extend into these grooves (6) in such a way that the coin lifters (7) lift the coins from the recesses (5) in the coin wheel (4) onto the coin track (8), where they lean against the coin rail (14) and individually roll past the coin sensor (9), which determines the type of each coin, after which the total value of the counted coins is calculated,
and wherein the coin path (15) is divided into two grooves (6) separated by an elevation (10) in the middle of the coin path (15) along at least the main part of its circular course on the coin wheel (4) and wherein two coin lifters (7) from the coin rail (14) extend into respective grooves (6) on respective sides of this elevation (10).

2. The compact automatic coin counter (1) according to claim 1, wherein the recesses (5) for collection of coins are circular in configuration.

3. The compact automatic coin counter (1) according to claim 2, wherein the diameter of the recesses (5) for collection of coins is between 2 cm and 7 cm, preferably between 3 cm and 5 cm.

4. The compact automatic coin counter (1) according to claim 1, wherein the depth of the recesses (5) for collection of coins is adapted so that each recess (5) can only transport a single coin up from the coin bowl (3) at a time.

5. The compact automatic coin counter (1) according to claim 1, wherein the recesses (5) for collection of coins are arranged along the outer periphery of the coin wheel (4).

6. The compact automatic coin counter (1) according to claim 1, wherein the coin path (15) is divided into two grooves (6) separated by an elevation (10) in the middle of the coin path (15) along at least the main part of its circular course on the coin wheel (4) and there are two coin lifters (7) from the coin rail (14) extending into respective grooves (6) on respective sides of this elevation (10).

7. The compact automatic coin counter (1) according to claim 6, wherein the elevation (10) is missing at one or more locations along the course of the coin path (15).

8. The compact automatic coin counter (1) according to claim 6, wherein the elevation (10) is provided with rounded edges (13).

9. The compact automatic coin counter (1) according to claim 1, wherein the coin wheel (4) is further provided with one or more through-going holes (12), which are so small that the coins cannot pass through them.

10. The compact automatic coin counter (1) according to claim 1, wherein the weight of the coin counter (1) is less than 10 kg, preferably less than 5 kg, most preferably less than 3 kg.

11. The compact automatic coin counter (1) according to claim 1, wherein the length of the coin counter (1) is less than 40 cm, preferably less than 25 cm.

12. The compact automatic coin counter (1) according to claim 1, wherein the height and width of the coin counter (1) are both less than 30 cm, preferably less than 20 cm.

* * * * *